US005809890A

United States Patent [19]

Knauer et al.

[11] Patent Number: 5,809,890

[45] Date of Patent: Sep. 22, 1998

[54] ARRANGEMENT FOR FASTENING A COVER ON A PRINTING CYLINDER

[75] Inventors: Peter Knauer, Münster/Lech; Klaus T. Reichel; Josef Singler, both of Augsburg, all of Germany

[73] Assignee: MAN Roland Druckmaschinen AG, Offenbach am Main, Germany

[21] Appl. No.: 781,373

[22] Filed: Jan. 21, 1997

[30] Foreign Application Priority Data

Jan. 19, 1996 [DE] Germany ..... 296 00 845 U

[51] Int. Cl.[6] ..... B41F 1/28

[52] U.S. Cl. ..... 101/415.1; 101/378

[58] Field of Search ..... 101/415.1, 382.1, 101/383, 378

[56] References Cited

U.S. PATENT DOCUMENTS

| | | | |
|---|---|---|---|
| 3,727,551 | 4/1973 | Kostas et al. | 101/415.1 |
| 5,107,763 | 4/1992 | Gevis | 101/382.1 |
| 5,131,327 | 7/1992 | Nagasono et al. | 101/415.1 |
| 5,255,604 | 10/1993 | Durr | 101/415.1 |
| 5,363,764 | 11/1994 | Horiguche et al. | 101/415.1 |
| 5,413,042 | 5/1995 | Weiss et al. | 101/382.1 |
| 5,483,891 | 1/1996 | Reichel | 101/415.1 |

FOREIGN PATENT DOCUMENTS

| | | |
|---|---|---|
| 0534579 | 3/1993 | European Pat. Off. . |
| 4319167 | 12/1994 | Germany . |
| 29507523 | 8/1995 | Germany . |
| 4415621 | 11/1995 | Germany . |
| 9309952 | 5/1993 | WIPO . |

*Primary Examiner*—John S. Hilten
*Assistant Examiner*—Anthony H. Nguyen
*Attorney, Agent, or Firm*—Cohen, Pontani, Lieberman, Pavane

[57] ABSTRACT

An arrangement for fastening a covering on a cylinder of a printing machine, the arrangement including a cylinder having at least one axially extending cylinder groove which defines a groove wall at an acute angle to an outer surface of the cylinder, and a covering including at least one flexible support plate having a leading flange and a trailing flange that are inserted into the cylinder groove so that the leading flange engages the groove wall and the trailing flange is adjacent the leading flange. A spindle is arranged in the cylinder groove so as to be rotatable between a release position and a clamping position, and a leaf spring is mounted on the spindle so as to press, in the clamping position of the spindle, the trailing flange and the leading flange against the groove wall.

13 Claims, 6 Drawing Sheets

ARRANGEMENT FOR FASTENING A COVER ON A PRINTING CYLINDER

BACKGROUND OF THE INVENTION

1. Field of the Invention

The present invention relates to an arrangement for fastening a covering on an printing unit cylinder of a printing press. The covering can, for instance, be a flexible printing plate or a rubber-blanket unit consisting of a flexible support plate and a rubber coating.

2. Description of the Prior Art

German reference DE 295 07 523 U1 shows a device for fastening a rubber-blanket unit on a blanket cylinder. In accordance therewith, the bent-over flanges of the support plate for the rubber blanket are inserted into a narrow slot in the cylinder. In its lower region, the slot is tangent to a longitudinal bore in the cylinder within which there is a clamping spindle which contains radially resilient rams. By a suitable turning of the clamping spindle, the rams are directed against the flanges of the support plate and press them against one wall of the slot. The device, to be sure, has a narrow clamping channel, but it is difficult to manufacture. Thus, upon penetration through the slot and the bore of the blanket cylinder, tapered end regions of material are produced which are forced away by the machine tool and must subsequently be removed, at great effort, by hand since they have a disturbing effect on the rotation of the spindle. Furthermore, the narrow milling tool can be forced away and damaged. Still further, the entrance edges of the slot must be rounded with different radius millers (acute and obtuse guide flanges). The device additionally requires long flanges of the support plate, which impedes their insertion into and removal from the slot. Furthermore, long flanges are, by their nature, not easy to handle in view of their slight stiffness. Long flanges are also difficult to slide into the slot when the blanket cylinder is rolled over in contact with other cylinders, since the tendency to form kinks increases quadratically with the length of the flanges. Finally, the flanges are not loaded uniformly by the resilient rams over their length.

WO 93/09952 also shows the fastening of a rubber-blanket unit on a blanket cylinder. Here, a clamping slot is provided, on the edge of which the leading flange of the support is hooked. The trailing flange is pressed in the bottom of the slot by a cam against a wall of the slot. This flange is again very long and has the disadvantages already described above. Furthermore, the cam fastening holds the trailing flange of the support firm in a non-displaceable manner, so that subsequent shifting, i.e. subsequent clamping when the blanket cylinder is rolled over, is not possible.

A device for fastening a printing plate on a form cylinder is shown in European reference EP 0 534 579 A2. The form cylinder has a cylinder groove extending in axial direction, within which there is a swingable clamping spindle. The spindle bears U-shaped leaf springs. One flange of the leaf springs presses the leading flange of the plate against a wall of the groove while the second spring arm is bent and engages into an angular bend of the trailing flange of the plate. In order to be able to contain and swing both spring arms, a correspondingly wide clamping channel is necessary. A greater width of the channel is also necessary in order to be able to introduce the trailing flange of the plate with its bend into the cylinder groove. A wide channel produces large vibrations in the printing unit and causes correspondingly wide non-printable stripes on the web.

SUMMARY OF THE INVENTION

Accordingly, it is an object of the present invention to provide an arrangement for fastening a covering on a printing unit cylinder of a printing press which has a narrow clamping channel, can easily be manufactured, and reliably clamps the flanges of the covering.

Pursuant to this object, and others which will become apparent hereafter, one aspect of the present invention resides in an arrangement for fastening a covering on a cylinder of a printing machine, which arrangement includes a cylinder having at least one axially extending cylinder groove which defines a groove wall at an acute angle to an outer surface of the cylinder. The arrangement further includes a covering having at least one flexible support plate with a leading flange and a trailing flange therein insertable into the cylinder groove so that the leading flange engages the groove wall and the trailing flange is adjacent the leading flange. A spindle is arranged in the cylinder groove so as to be rotatable between a release position and a clamping position. A leaf spring is mounted on the spindle so as to press, in the clamping position of the spindle, the trailing flange and the leading flange against the groove wall.

Due to the leaf spring, the inventive device reliably clamps the flanges of the covering with a high uniform force, i.e. a force which is applied over the entire width of the flange, against a wall of the groove and permits subsequent clamping by further pushing-in of the flanges. Since the flanges are short, this is readily possibly while avoiding kinks. Furthermore, the short flanges can easily be inserted into and removed from the cylinder groove. In addition, the shortness of the flanges makes them stiffer and easier to handle.

Furthermore, the inventive device can be produced in a technologically uncomplicated manner. Thus, upon the slotting of the cylinder groove, no burrs of material are produced at the transition between the deep-hole boring and the channel, since the milling tool need not produce a continuous cut and need not cut any material tangentially, and is therefore not pressed away, with the danger of damage to it. The radii of the channel edges in the entrance region of the cylinder groove can be produced with the same radius miller.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
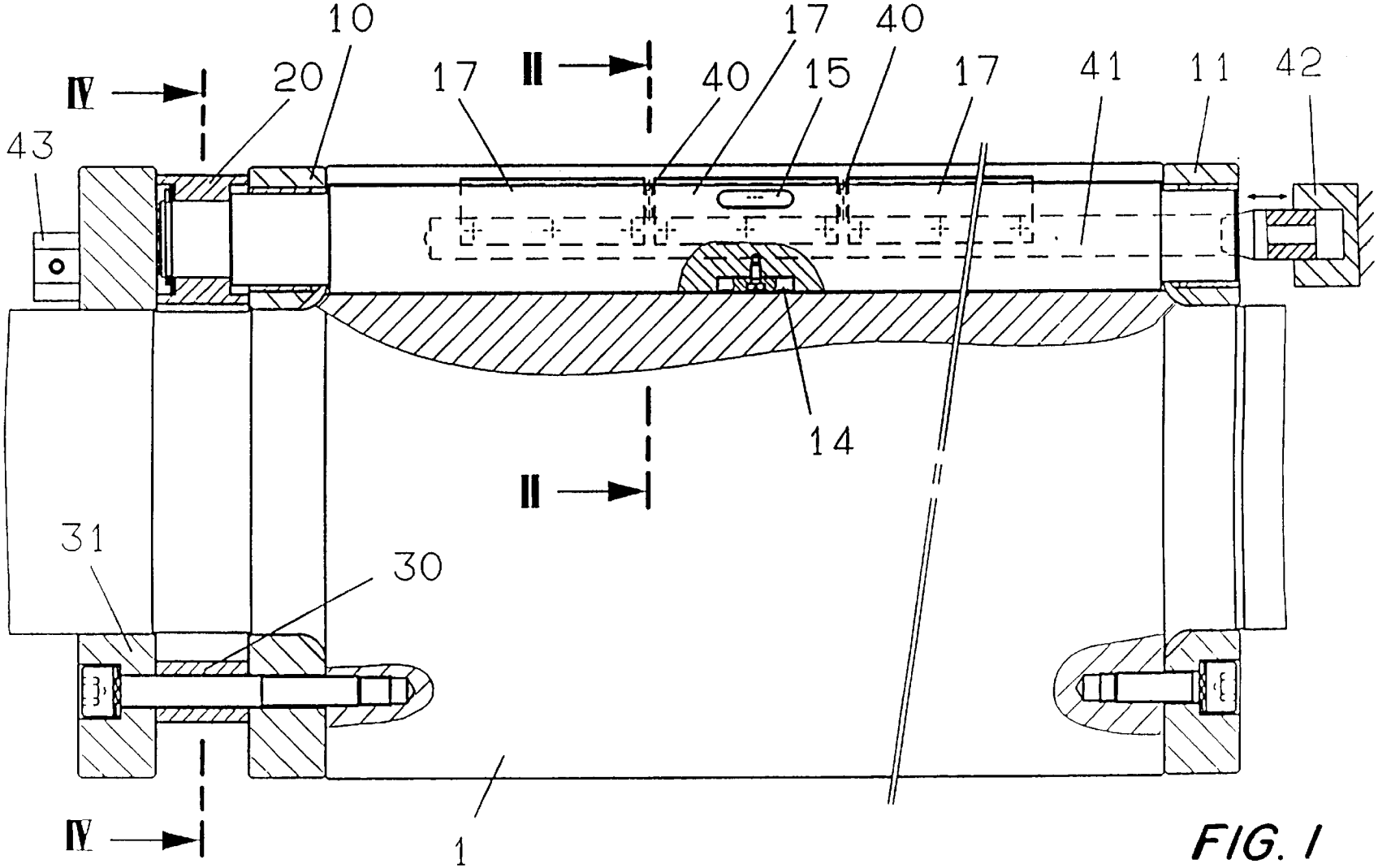
FIG. 1 is an elevational view, partially in section, of a blanket cylinder.
Figure 2:
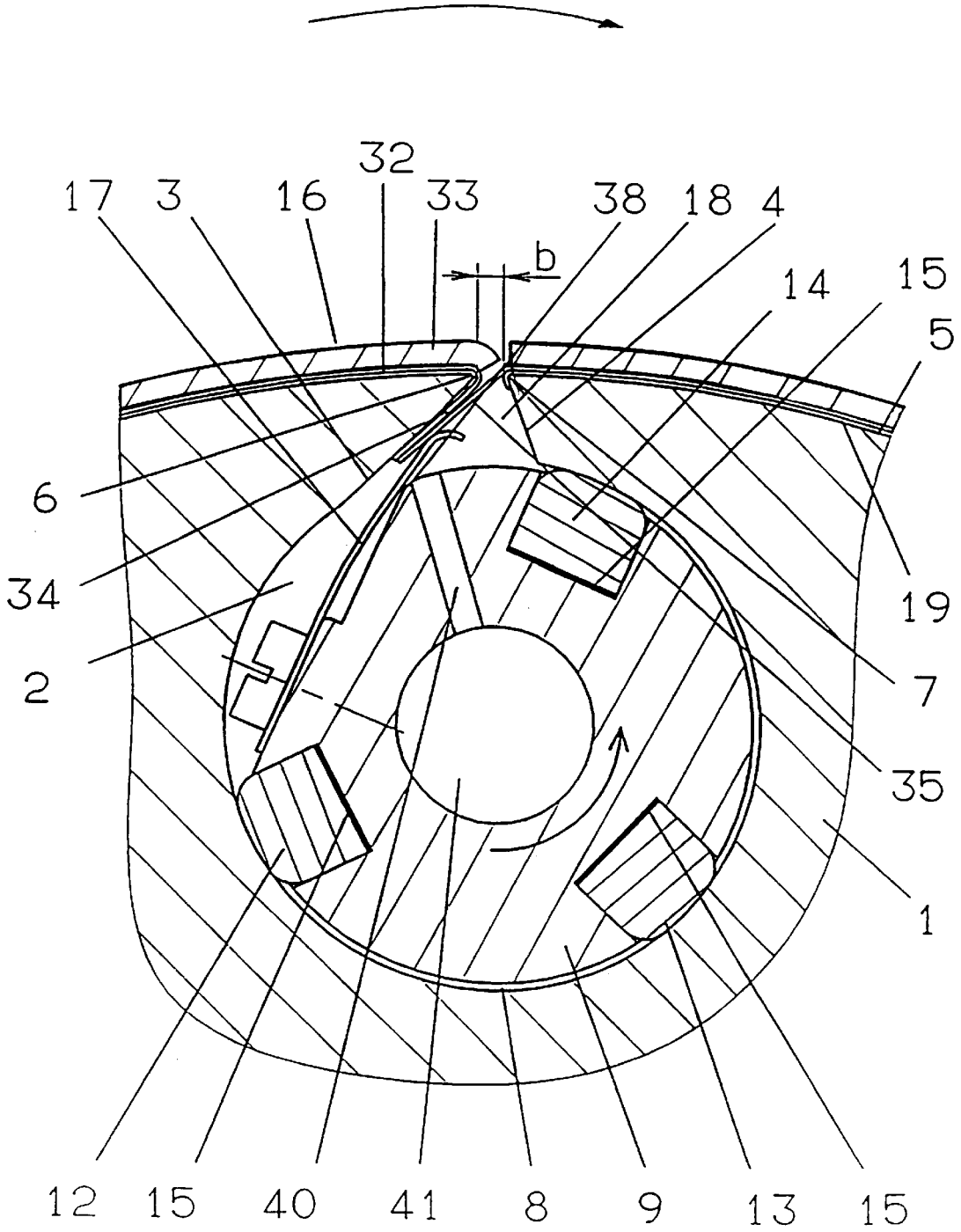
FIG. 2 is a section along the line II—II of FIG. 1, with the spindle in the clamping position.

The blanket cylinder 1 shown in FIGS. 1 and 2 has a cylinder groove 2 which extends in the axial direction. The groove walls 3, 4 are directed at an acute angle to the outer surface 5 of the cylinder and form the edges 6 and 7 with it (FIG. 2). At the bottom, the cylinder groove 2 ends with a bore 8 extending in its longitudinal direction. A spindle 9 is arranged within the bore. The spindle 9 is rotatably mounted in disks 10, 11 screwed onto the ends of the blanket cylinder 1. A displaceable arrangement of the spindle 9 is also possible. In order to avoid sags, support elements 12–14 are distributed around the circumference of the spindle 9. The support elements 12–14 support the spindle 9 in the bore 8. The support elements 12–14 can be mounted adjustable in height by shims 15 in order to be able to compensate for manufacturing tolerances of the bore 8.

Several leaf springs 17 are screwed onto the spindle 9 so as to be distributed over the length of the rubber-blanket unit 16 which is to be fastened on the blanket cylinder 1. The leaf springs 17 extend up into a free space 18 which is created by the aforementioned favorable acute-angle arrangement of the groove walls 3, 4. The free space 18 can easily be produced by milling or sawing on both sides. This cutting on both sides does not result in any increase in the width b of the clamping channel which extends through the outer surface of the blanket cylinder 1 as compared with the width obtainable upon the milling of a slot. The outer surface 5 of the cylinder 1 is covered by an anti-corrosion layer, in the embodiment shown a galvanic layer 19, or else, for instance, a flame-spray layer. This galvanic layer 19 extends up into the entrance region of the cylinder groove 2. In this way, the clamping channel can be produced with a wider tool since the edges 6, 7 provided with the galvanic layer 19 reduce the width of the clamping channel by two layer thicknesses.

Figure 4:
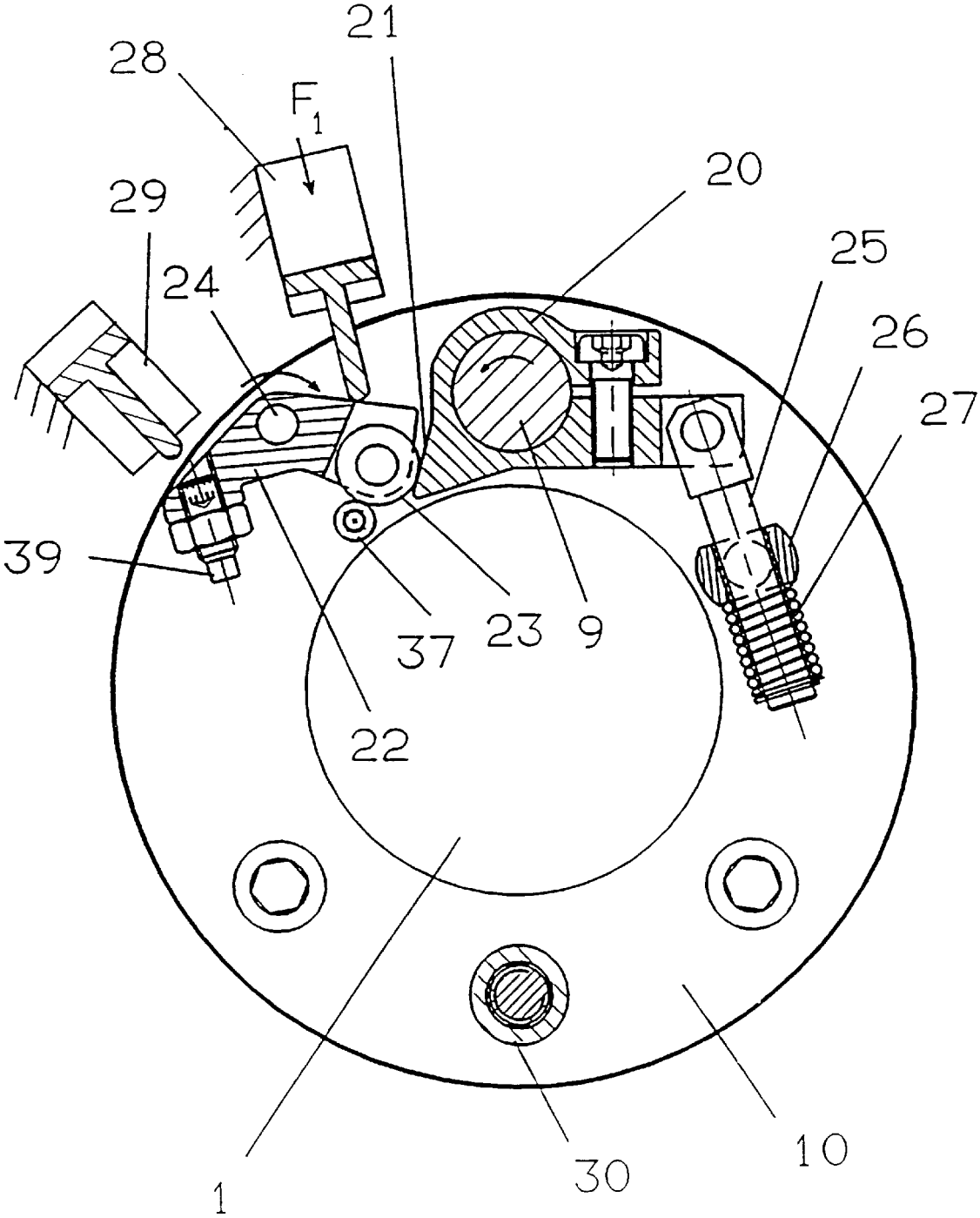
FIG. 4 is a section along the line IV—IV of FIG. 1, in the clamping position of the device.

FIG. 4 shows the mechanism which acts on the spindle 9 in order to swing it optionally into the clamping position or the release position. In detail, a lever 20 is clamped fast on the part of the spindle 9 extending out of the disk 10. The lever 20 has a cam 21. The roller 23 of a roller lever 22 mounted on the blanket cylinder 1 can be swung onto the cam 21. The roller lever 22 is mounted on a pin 24 inserted into the disk 10 and therefore indirectly on the blanket cylinder 1. A connecting rod 25 acts in a pivoted manner on the lever 20, and is displaceable in a bearing 26 which is fastened to the disk 10, and therefore indirectly on the blanket cylinder 1. The connecting rod 25 is acted on by a compression spring 27. Instead of the connecting rod 25, a tension spring could also, for instance, be attached to the lever 20. Two work cylinders 28, 29 are fixed on to a frame and cooperate with the roller lever 22. These work cylinders 28, 29 can, for instance, be screwed onto the inner side of the side wall of a printing unit. The mechanism parts present on the blanket cylinder 1 are advantageously covered by a cover 31 which is screwed, with spacing (spacer sleeves 30, FIG. 1), to the disk 10.

The rubber-blanket unit 16 which is to be mounted on the blanket cylinder 1 consists of a support plate 32 on which a rubber blanket 33 is fastened, for instance bonded or vulcanized. The support plate 32 has a leading flange 34 and a trailing flange 35, respectively. These flanges 34, 35 are not covered by the rubber blanket 33. The rubber blanket 33 may be compressible or non-compressible. For mounting the rubber-blanket unit 16, the spindle 9 is in the release position shown in FIG. 3. In this release position, the leaf springs 17 are swung away from the groove wall 3 so that the leading flange 34 of the rubber-blanket unit 16 can be inserted into the clamping channel and hung on the edge 6. Thereupon the rubber-blanket unit 16 is wound around the blanket cylinder and the trailing flange is inserted into the cylinder groove 2. Due to the shortness of this flange 35, the insertion can also be effected automatically. The inserted trailing flange 35 comes to lie between the leading flange 34 and the leaf springs 17 (FIG. 3).

The spindle 9 is now swung into the clamping position (FIG. 2). For this, there is used the mechanism shown in FIGS. 4 and 5, which is in the release position in FIG. 5. By reversing the working cylinder 28, the piston rod of the cylinder 28 extends out and strikes the lever 22 with a force $F_1$, whereupon the lever 22 swings, until striking a stop 37, into the clamped position shown in FIG. 4. The piston rod of the working cylinder 29 is retracted. Upon this swinging movement the roller 23 presses against the cam 21 of the lever 20 and swings the lever 20, together with the spindle 9, in the direction indicated in FIG. 4. Upon this swinging movement, the lever 20 carries the connecting rod 25 along with it against the force of the compression spring 27. The force of the compression spring 27 produces a moment of rotation on the lever 20 which opposes the swinging but the value of which is such that swinging in the direction of the clamping position (direction of the arrow) nevertheless takes place. The force of the compression spring 27 results in a force lock between the roller 23 and the cam 21. Upon carrying out the swinging movement of the roller lever 22 into the clamping position shown in FIG. 4, the lever passes through a dead-center position and then, upon slight further rotation, striking against the stop 37, enters a position beyond dead center. In this position beyond dead center, the clamping forces acting on the leaf springs 17 (reaction forces) as well as the pulling force of the connecting rod 25 cannot swing the lever 20 and the spindle 9 back so that the work cylinder 28 can be reversed and its piston rod retracted.

In the clamped position (FIGS. 2 and 4), the leaf springs 17 reliably press the flanges 34, 35 of the support plate, resting against each other, against the leading groove wall 3. The stop 37 assures the exact positioning of the leaf springs 17. In order to protect the leaf springs 17 from being overloaded, with concomitant permanent deformation, particularly upon the mounting of the device, the spindle 9 has a nose 38 (FIG. 2) against which the leaf springs 17 rest upon excess rotation of the spindle 9 and are thereby still stressed in flexure only with a short lever arm. Instead of a large number of leaf springs 17, a single continuous leaf spring having the width of the flanges 34, 35 can also be used.

Figure 3:
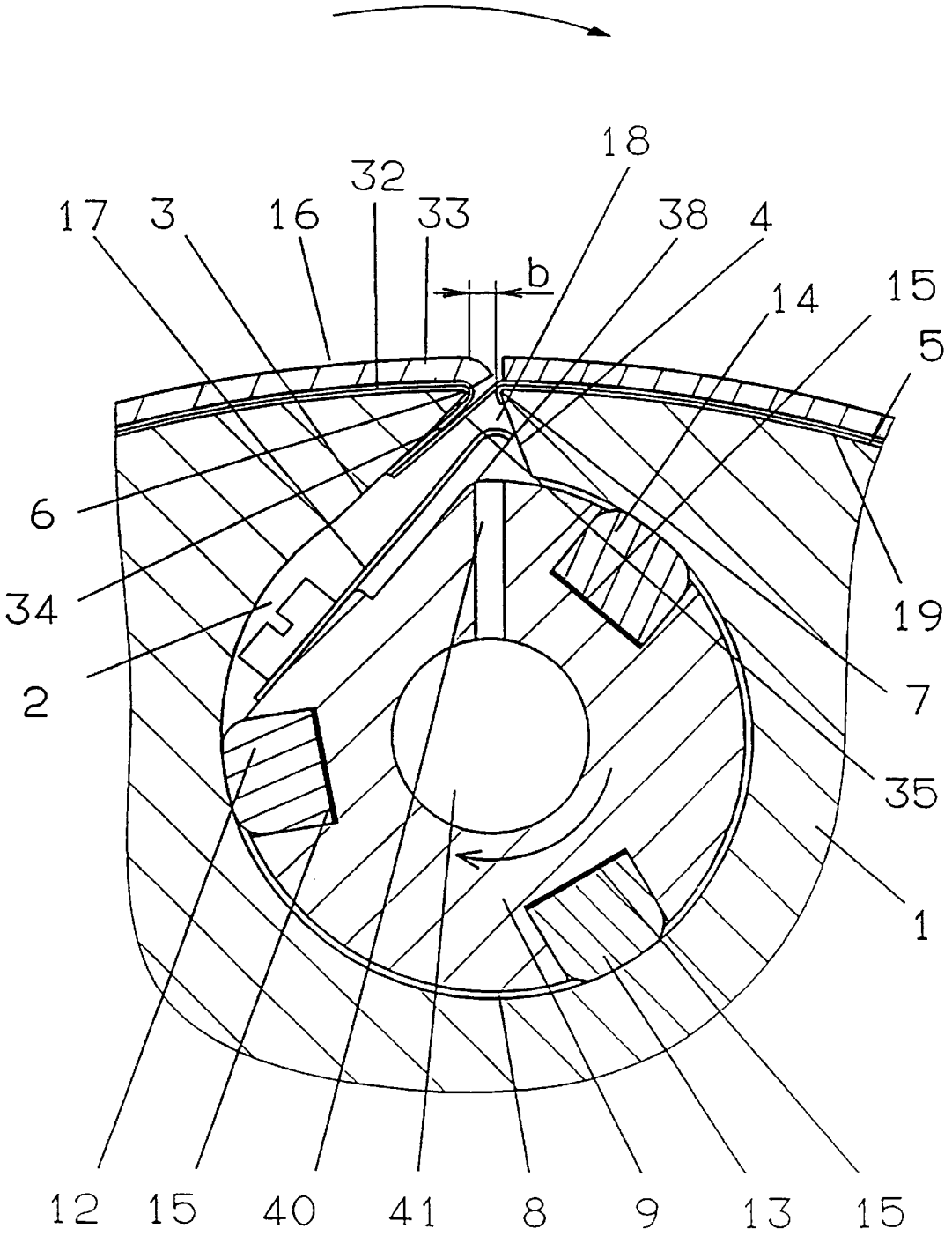
FIG. 3 shows the release position corresponding to FIG. 2.
Figure 5:
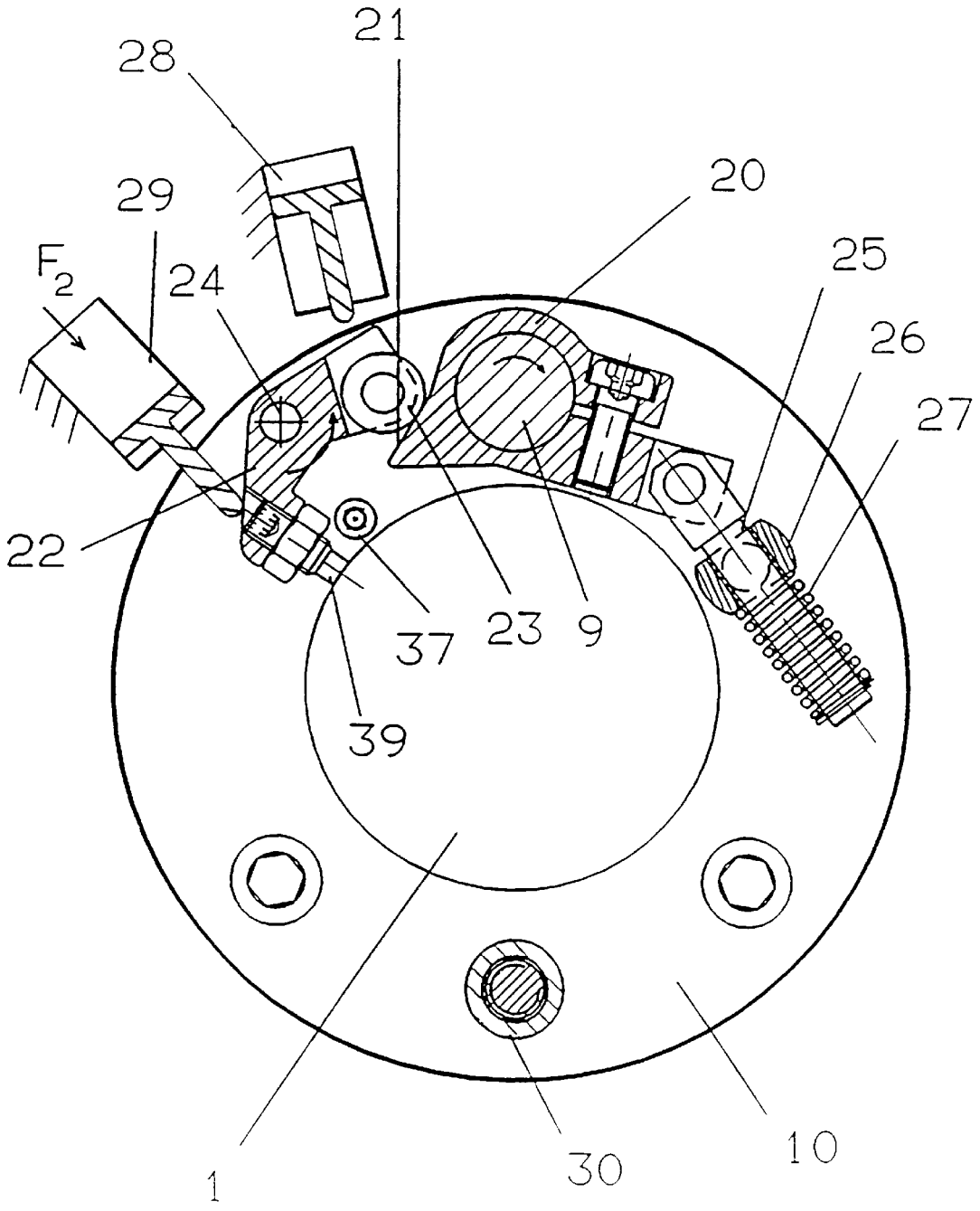
FIG. 5 shows the release position corresponding to FIG. 4.

For the removal of the rubber-blanket unit 16, the spindle 9 is swung into the position of release shown in FIGS. 3 and 5 in the direction indicated in those figures. For this purpose, the working cylinder 29 is reversed, whereupon its outward-moving piston rod applies to the roller lever 22 the force $F_2$, the lever thereby swinging in the direction indicated in FIG. 5 to the position shown. The swinging is limited by means of an adjustable stop 39 which comes against the pin of the blanket cylinder 1. Upon this swinging movement, the lever 20 with its cam 21, under the pulling action of the connecting rod 25, follows the roller 23 which swings away, thus swinging the spindle 9 into the release position. The rubber-blanket unit 16 can now be removed from the rubber blanket cylinder 1. For this purpose, the trailing flange 35 is first of all pulled out of the cylinder groove 2. Assisting in this, an air jet is blown out of the spindle 9 in the direction of the entrance region of the cylinder pit 2 under the trailing flange 35. The spindle 9 has, for this purpose, in the regions between the leaf springs 17, in each case a jet opening 40 directed, in the release position of the spindle 9, onto the entrance region of the cylinder groove 2. The jet holes 40 are in communication with a feed channel 41 present in the center of the spindle 9. The channel 41 exits at one end of the spindle 9 on which a feed unit 42 for compressed air is arranged fixed to the frame. In the event of a single continuous leaf spring on the spindle 9, it is provided in each case with an opening in the region of a jet hole 40.

The spindle 9 can also be swung by other mechanisms. Thus, there can be fastened to the spindle 9 a lever which is articulated to a swing lever which is under spring action, both levers being deflectable on both sides of an extended position. Mechanisms can also be arranged on both spindle ends and therefore on both ends of the blanket cylinder 1. Furthermore, manual actuation can be provided for the swinging of the spindle 9. For this, the roller lever 22 has, for instance, centrally to its point of swing, a hexagon head 43 which protrudes from the cover 31 and on which a wrench can be placed in order to swing the hexagon head 43, together with the roller lever 22 (FIG. 1).

Figure 6:
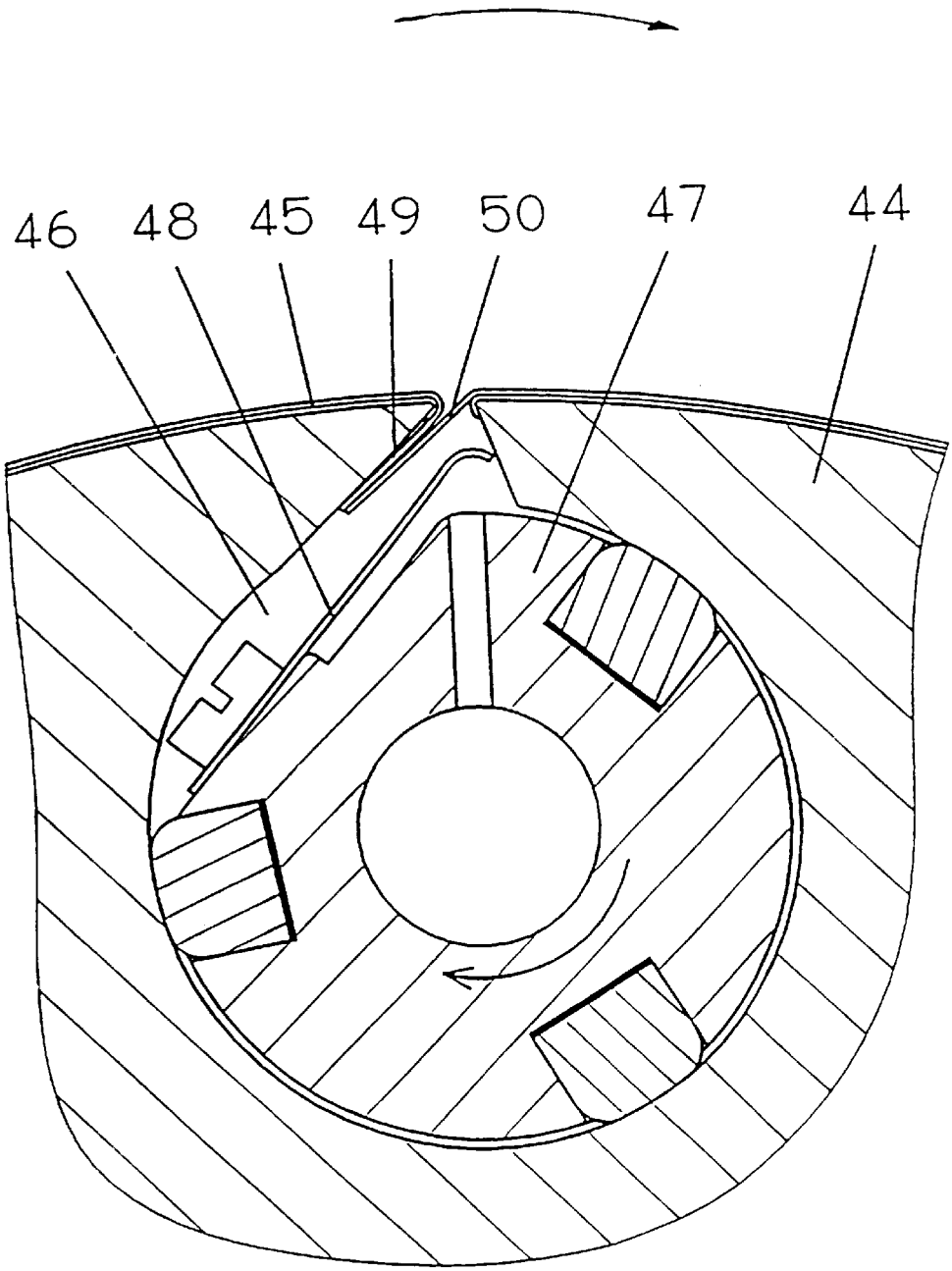
FIG. 6 shows the cylinder groove of a form cylinder in cross section.

As a further embodiment, FIG. 6 shows a form cylinder 44 on which a printing plate 45, for instance an offset printing plate, is fastened. Only the cylinder groove 46 is shown in the cross section, together with the spindle 47 and the leaf springs 48 which clamp the flanges 49, 50. Further explanations can be dispensed with since the device is the same as that already described in connection with the blanket cylinder 1. Although different reference numerals have been indicated, the parts for clamping the rubber-blanket unit 16 can be used identically for clamping the printing plate 45.

The invention can also be employed if there are pressed on the circumference of the printing-unit cylinder 1, 44 several cylinder grooves 2, 46 into each of which a leading flange and a trailing flange of two adjacent coverings to be fastened are inserted.

The invention is not limited by the embodiments described above which are presented as examples only but can be modified in various ways within the scope of protection defined by the appended patent claims.

I claim:

1. An arrangement in combination with a covering for fastening the covering on a cylinder of a printing machine, the arrangement comprising: a cylinder having at least one axially extending cylinder groove which defines a planar groove wall at an acute angle to an outer surface of the cylinder; a covering on the outer surface of said cylinder including at least one flexible support plate having a leading flange and a trailing flange that are inserted into the cylinder groove so that the leading flange engages the groove wall and the trailing flange is adjacent the leading flange; a spindle arranged in the cylinder groove so as to be rotatable between a release position and a clamping position; and a leaf spring mounted on the spindle so as to extend into a region of the cylinder groove between the outer surface of the cylinder and the spindle and so as to press, in the clamping position of the spindle, the leading flange against the groove wall and the trailing flange against the leading flange.

2. An arrangement according to claim 1, wherein the covering is a printing plate.

3. An arrangement according to claim 1, wherein the covering is a rubber-blanket unit including a rubber blanket fastened on the support plate except for the leading and trailing flanges.

4. An arrangement according to claim 1, and further comprising a protective layer arranged on an outer surface of the cylinder so as to extend into an entrance region of the cylinder groove.

5. An arrangement according to claim 1, wherein the spindle has a nose configured so that the leaf spring rests against the nose upon overstressing.

6. An arrangement according to claim 1, wherein the leaf spring is formed of a plurality of individual leaf springs distributed over a width of the covering.

7. An arrangement according to claim 6, wherein the spindle has, in a region between the leaf springs, a blast hole arranged so as to be directed against an entrance region of the cylinder a groove in the release position of the spindle, and a feed channel in fluid communication with the blast hole, and further comprising compressed air feed means for feeding compressed air to the feed channel.

8. An arrangement according to claim 1, and further comprising means for swinging the spindle into the clamping position in which the leaf spring is swung against the flanges of the support plate inserted into the cylinder groove, the swinging means being operative to assume a position beyond dead center in the clamping position.

9. An arrangement according to claim 8, and further comprising a lever mounted on the spindle, the lever having a cam, and a roller lever swingably mounted on the cylinder a roller being mounted on the roller lever, and still further comprising so as to engage the cam to impart a swinging movement to the spindle level, a connecting rod articulated to the spindle lever so as to counter the swinging movement.

10. An arrangement according to claim 9, and further comprising a bearing swingably fastened on the cylinder so as to displaceably guide the connecting rod, and a compression spring arranged to act on the connecting rod.

11. An arrangement according to claim 9, and further comprising a stop arranged to limit a path of swing of the roller lever in the clamping position.

12. An arrangement according to claim 9, and further comprising working cylinder means for acting on the roller lever to produce moments of rotation in opposite direction.

13. An arrangement in combination with a covering for fastening the covering on a cylinder of a printing machine, the arrangement comprising: a cylinder having at least one axially extending cylinder groove that defines a planar groove wall at an acute angle to an outer surface of the cylinder; a covering on the outer including at least one flexible support plate having a leading flange and a trailing flange that are inserted into the cylinder groove so that the leading flange engages the groove wall and the trailing flange is adjacent the leading flange; a spindle arranged in the cylinder groove so as to be rotatable between a release position and a clamping position; and, a plurality of individual leaf springs mounted on the spindle so as to be distributed over a width of the covering and so as to extend into a region of the cylinder groove between the outer surface of the cylinder and the spindle, the springs being configured to press the leading flange against the groove wall and the trailing flange against the leading flange in the clamping position of the spindle.

* * * * *